US008323416B2

(12) United States Patent
Bradley et al.

(10) Patent No.: US 8,323,416 B2
(45) Date of Patent: Dec. 4, 2012

(54) PROCESS AND COMPOSITION FOR REMOVING A SCALE DEPOSIT

(75) Inventors: Steven A. Bradley, Arlington Heights, IL (US); Walter Zamechek, Deerfield, IL (US)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 12/510,724

(22) Filed: Jul. 28, 2009

(65) Prior Publication Data

US 2009/0320876 A1 Dec. 31, 2009

Related U.S. Application Data

(63) Continuation-in-part of application No. 12/164,515, filed on Jun. 30, 2008, now abandoned.

(51) Int. Cl.
*C23G 1/02* (2006.01)

(52) U.S. Cl. ..... 134/3; 134/22.1; 134/22.11; 134/22.12; 134/22.19; 134/36; 134/40; 134/42; 510/247; 510/367; 510/372; 510/275; 510/434; 510/477; 510/480

(58) Field of Classification Search ..... 134/3, 22.1, 134/22.11, 22.12, 22.19, 36, 40, 42; 510/247, 510/367, 372, 275, 434, 477, 480
See application file for complete search history.

(56) References Cited

U.S. PATENT DOCUMENTS

| | | | | |
|---|---|---|---|---|
| 3,438,811 | A * | 4/1969 | Harriman et al. | 134/2 |
| 3,510,351 | A * | 5/1970 | Vollmer et al. | 134/22.11 |
| 3,705,098 | A * | 12/1972 | Shepherd et al. | 210/759 |
| 4,108,681 | A * | 8/1978 | Lawson et al. | 134/20 |
| 4,238,244 | A * | 12/1980 | Banks | 134/22.18 |
| 4,310,435 | A * | 1/1982 | Frenier | 507/219 |
| 4,443,268 | A * | 4/1984 | Cook | 134/2 |
| 4,610,972 | A * | 9/1986 | Hughes | 502/52 |
| 5,093,020 | A * | 3/1992 | Paul et al. | 134/22.14 |
| 5,108,582 | A * | 4/1992 | Foutsitzis et al. | 208/138 |
| 5,662,919 | A * | 9/1997 | Castillo et al. | 424/427 |
| 6,225,261 | B1 * | 5/2001 | Brezinski et al. | 507/90 |
| 6,277,271 | B1 * | 8/2001 | Kocal | 208/212 |
| 6,402,940 | B1 * | 6/2002 | Rappas | 208/240 |
| 6,436,880 | B1 * | 8/2002 | Frenier | 507/244 |
| 7,563,377 | B1 * | 7/2009 | Simpson | 210/698 |
| 2002/0196891 | A1 * | 12/2002 | Rootham et al. | 376/305 |
| 2003/0004081 | A1 * | 1/2003 | Ellis et al. | 510/247 |
| 2003/0094400 | A1 * | 5/2003 | Levy et al. | 208/222 |
| 2003/0118470 | A1 * | 6/2003 | Frost | 422/7 |
| 2005/0145826 | A1 * | 7/2005 | McClung | 252/180 |
| 2006/0042663 | A1 * | 3/2006 | Fulmer et al. | 134/26 |
| 2006/0042665 | A1 * | 3/2006 | Fernholz et al. | 134/42 |
| 2007/0125987 | A1 * | 6/2007 | Hills et al. | 252/408.1 |
| 2007/0151901 | A1 * | 7/2007 | Sain et al. | 208/208 R |
| 2007/0221246 | A1 * | 9/2007 | Keatch | 134/3 |

FOREIGN PATENT DOCUMENTS

JP 2007307478 * 11/2007

* cited by examiner

*Primary Examiner* — Bibi Carrillo
(74) *Attorney, Agent, or Firm* — Mark R Willis

(57) ABSTRACT

One exemplary embodiment can be a process for removing one or more scale deposits formed on a surface. The process can include contacting the surface with a composition for a period of time sufficient to remove the scale deposits that comprise coke or metal sulfides or mixtures thereof. Generally, the composition includes an effective amount of an organic acid and/or a salt thereof, and an effective amount of an oxidizing agent.

14 Claims, 1 Drawing Sheet

PROCESS AND COMPOSITION FOR REMOVING A SCALE DEPOSIT

CROSS-REFERENCE TO RELATED APPLICATION

This application is a Continuation-In-Part of application Ser. No. 12/164,515 filed Jun. 30, 2008, now abandoned, the contents of which are hereby incorporated by reference in its entirety.

FIELD OF THE INVENTION

The field of this invention generally relates to a process and composition for removing a scale deposit.

DESCRIPTION OF THE RELATED ART

During processes, e.g., chemical and petrochemical processes, various fluids can be directly or indirectly associated for transferring energy or mass. As an example, often fluids are associated for heat transfer operations in equipment, such as heat exchangers.

During such operations, the heat exchanger can become fouled with scale deposits on the various surfaces, including internal components. The scale deposits can contain a variety of components, such as coke and metal sulfides. In some instances, the scale deposits can become quite thick.

As a result, scale deposits can reduce the heat transfer of the equipment and often can impact performance. In severe cases, the equipment may require replacement. In addition, the scale deposit may become friable, loosen, and foul the internals of downstream equipment.

As a consequence, it would be desirable to clean such equipment of scale deposit during, e.g., a maintenance shutdown. Unfortunately, cleaning solutions can either be of insufficient strength to remove the scale deposits, or too aggressive and damage the equipment. Consequently, there is a desire to identify a cleaning composition with sufficient strength to remove scale deposits but not damage the equipment.

SUMMARY OF THE INVENTION

One exemplary embodiment can be a process for removing one or more scale deposits formed on a surface. The process can include contacting the surface with a composition for a period of time sufficient to remove the one or more scale deposits. Generally, the composition includes an effective amount of an organic acid and/or a salt thereof, and an effective amount of an oxidizing agent.

Another exemplary embodiment may be a process for making a scale removal composition. The process may include combining effective amounts of an organic acid and/or a salt thereof and an oxidizing agent with water forming a composition for removing a scale deposit comprising sulfur.

A further exemplary embodiment may be a scale removal composition. The scale removal composition can be made by comprising an effective amount of citric acid and/or a salt thereof, an effective amount of hydrogen peroxide, and water.

The exemplary process and composition disclosed herein is effective for removing scale deposits without aggressively impacting the surface of the apparatus. Thus, the embodiments herein can permit the cleaning of equipment rather than replacing, and allow improving, e.g., the heat transfer efficiency, after cleaning of the equipment. The scale deposits that are being removed are primarily metal sulfides such as iron sulfide, nickel sulfide, iron-nickel sulfide, chromium sulfide, iron-chromium sulfide and mixtures thereof. The scale deposits may also include carbon, most often in the form of coke.

Definitions

As used herein, hydrocarbon molecules may be abbreviated C1, C2, C3 . . . Cn where "n" represents the number of carbon atoms in the hydrocarbon molecule.

As used herein, the term "scale deposit" generally means any accumulation of a material on a surface. The accumulation can be a precipitate or a crystal of one or more of coke or sulfides of iron, nickel or chromium or mixtures thereof.

As used herein, the term "surface" generally means one or more interior and/or exterior portions of an apparatus, a vessel, or other processing equipment, such as piping; and may have any shape, such as curved, circular, angular, tubular, or flat.

DETAILED DESCRIPTION

Figure 1:
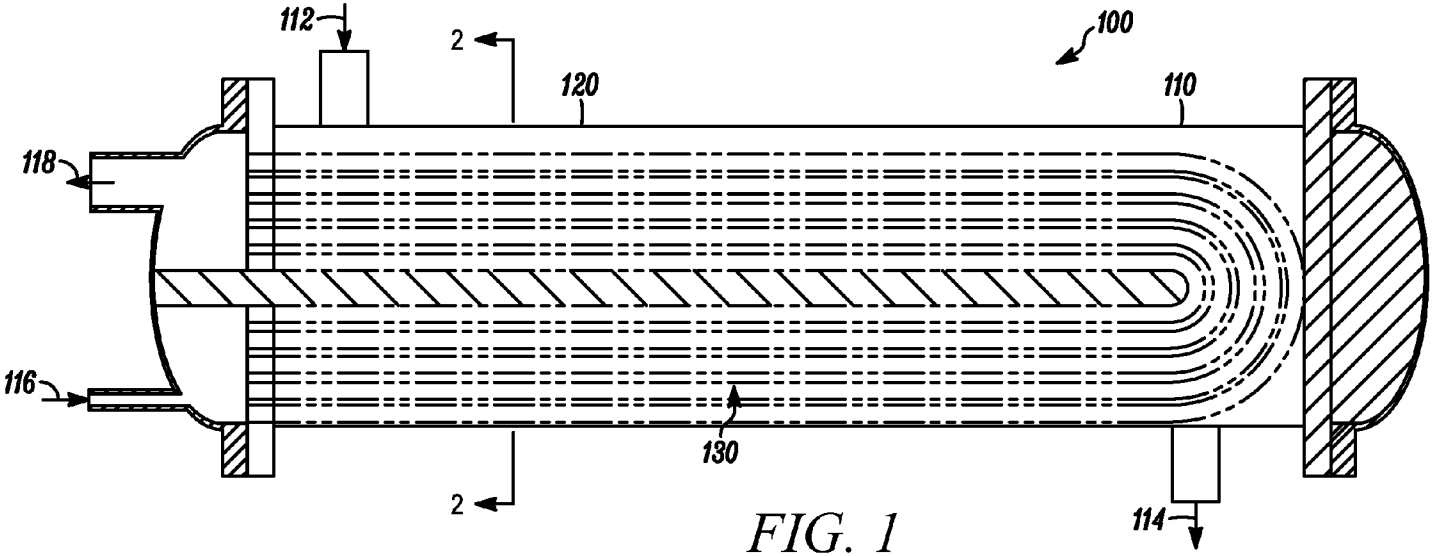
FIG. 1 is a cross-sectional, elevational view of an exemplary heat exchanger.
Figure 2:
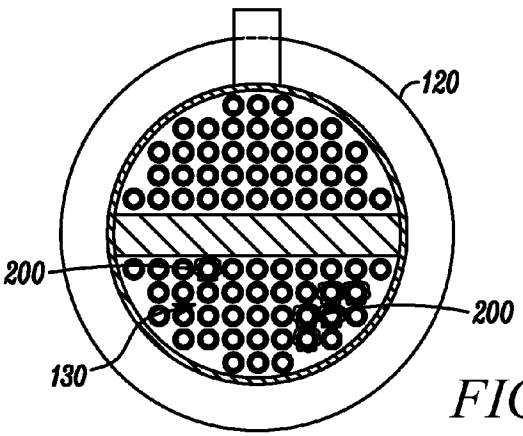
FIG. 2 is a cross-sectional, elevational view along line 2-2 of FIG. 1 of the exemplary heat exchanger.

Referring to FIGS. 1 and 2, an exemplary apparatus 100 is depicted, which in this desired embodiment is a shell-and-tube heat exchanger 110. However, it should be understood that other apparatuses, such as furnaces, reboilers, reactors, or other heat exchangers, may also be suited for application of the embodiments disclosed herein. Particularly, equipment with tubular structures may be particularly suited for application. Equipment, apparatuses, and/or vessels can be fabricated from any suitable material, such as carbon steel, stainless steel and/or titanium. The exchanger 110 can include a shell inlet 112 and a shell outlet 114 for a first fluid and a tube inlet 116 and a tube outlet 118 for a second fluid. The exchanger 110 can further include a shell 120 and one or more tubes 130, typically in the form of a bundle.

Such an exchanger 110 can be used in many hydrocarbon processes, such as reforming, aromatic complexing, cracking, alkylating, polymerizing, hydrotreating, dehydrogenating, and isomerizing. Exemplary processes can include dehydrogenation of C3 to C5 paraffins to their corresponding olefins, and the conversion of C3 to C5 hydrocarbons to aromatics. In such processes, often dimethyl disulfide and/or hydrogen sulfide is injected to minimize coke formation in a reactor.

Unfortunately, the hydrogen sulfide can facilitate the formation of scale deposits 200 on one or more tubes 130 in the exchanger 110 that can reduce heat transfer and foul downstream equipment. Typically, a scale deposit 200 can include any material. Often, the material can include iron and sulfur, but may include other materials such as chromium, carbon, nitrogen, and/or aluminum.

A scale removal composition can be utilized for removing the scale deposit 200. The composition can include an effective amount of an organic acid and/or a salt thereof, and an effective amount of an oxidizing agent. The organic acid and/or a salt thereof and the oxidizing agent can be provided in a medium, such as a solvent. An exemplary medium is water, which may include other impurities, such as less than about 500 mg per liter of dissolved solids.

The organic acid can be citric acid, oxalic acid, nitrilotriacetic acid, and polyacetic acid, with citric acid being preferred. Specific salts of the organic acid can include ammonium citrate, sodium citrate, and potassium citrate, with ammonium citrate being preferred.

The oxidizing agent can be a compound that evolves oxygen, such as a peroxide, a chlorate, a perchlorate, a nitrate, or a permanganate. Exemplary oxidizing agents are hydrogen peroxide, sodium peroxide, and potassium peroxide, with hydrogen peroxide being preferred.

The organic acid and/or the salt thereof, and the oxidizing agent in the composition may be in any suitable proportion. Preferably, the organic acid and/or the salt thereof, and the oxidizing agent are in a weight ratio of about 10:1 to about 1:10, about 5:1 to about 1:5, or about 2.5:1 to about 1:2.5. In one preferred composition, the organic acid or salt thereof can be citric acid or ammonium citrate, and the oxidizing agent can be hydrogen peroxide. The weight ratio of the citric acid or ammonium citrate to the hydrogen peroxide can be about 10:1 to about 1:10, about 5:1 to about 1:5, or about 2.5:1 to about 1:2.5.

The proportions of organic acid and/or the salt thereof, and the oxidizing agent are maintained so that the pH of the composition is neutral, i.e. less than about 7.5 or below and preferred between 5 and 6. The conditions must be maintained to avoid polythionic acid stress corrosion cracking until the scale has been fully removed. It is known that the combination of water and oxygen with the sulfide scale can produce polythionic acid. Once polythionic acid forms during a shutdown, it can cause cracking of sensitized stainless steel. Accordingly, the present invention does not require the normal preventive neutralization practice. Therefore, a basic pH is not needed to prevent the formation of polythionic acid as required by the National Association for Corrosion Engineers recommended practice for preventing polythionic acid stress corrosion cracking, the industry standard. NACE method RP0170 for Protection of Austenitic Stainless Steel and other Austenitic Alloys from Polythionic Acid Stress Corrosion Cracking during Shutdown of Refinery Equipment states that a neutralization solution to prevent polythionic acid stress corrosion cracking must have a pH greater than 9. Maintaining the active oxidizer prevents polythionic acid stress corrosion cracking until the scale has been fully removed. Once the scale has been removed, polythionic acid stress corrosion cracking is no longer an issue.

The composition can include any suitable amount of the medium in combination with the organic acid or salt thereof. Generally, the composition includes at least about 50%, preferably at least about 80%, and optimally at least about 90%, by weight of the medium. In some preferred embodiments, the medium can include water and the composition may include at least about 50%, preferably at least about 80%, and optimally at least about 90%, by weight of water.

The composition can be made by combining the organic acid and/or salt, the oxidizing agent, and the medium in any order at ambient conditions, i.e., a temperature of about 20° C. and a pressure of about 100 kPa, in any suitable container. Afterwards, the combination can be stirred until the components are sufficiently mixed.

The composition can be applied to scale deposits for any suitable time, such as at least about 30, at least about 60, or even at least about 120 minutes at a temperature of about 30° to about 80° C., preferably about 60° C., at a pressure of about 100 to about 10,000 kPa, preferably about 100 to about 1,000 kPa. Desirably, a plurality of applications or leaches are made, such as one, two, three, or even four with each stage of application being, independently, at least about 30, at least about 60, or even at least about 120 minutes. In some preferred embodiments, the applications or leaches can even be longer, such as at least about 1—at least about 3 days for each leach. The time, temperature, pressure, and number of stages can vary depending on the type and amount of scale deposit, and the dimension and location of the surface within the apparatus or vessel. The composition can be applied in a batch or continuous process. As much as about 50%, even at least about 70%, by weight, of the scale can be removed by the embodiments herein.

Illustrative Embodiments

The following examples are intended to further illustrate the subject matter disclosed herein. These illustrations of embodiments of the invention are not meant to limit the claims of this invention to the particular details of these examples. These examples are based on engineering calculations and actual operating experience with similar processes.

EXAMPLE 1

Various chemicals are applied to a scale deposit that includes in percent, by weight: 37.5 Fe, 8.6 Cr, 4.3 Ni, 1.0 Al, 32.6 S, and 12.5 C, with a remainder of 3.5% of other components. Several solutions are made at room temperature and atmospheric pressure. Solution A is made by adding 0.15 gram citric acid and 0.2 ml of peroxide to 4 ml of water to yield a solution of about 4%, by weight, of citric acid in water. Solution B is a 5%, by volume, of hydrochloric acid in water. Solution C is obtained by adding 0.15 ml of 30%, by weight, hydrogen peroxide to 2 ml of water to yield a solution of about 8%, by weight, hydrogen peroxide. Solution D is obtained by adding nitric acid to Solution C to obtain 11%, by weight, of nitric acid and hydrogen peroxide. Solution E is obtained by adding 0.15 gram ammonium citrate and 0.2 ml of peroxide to 4 ml of water to yield a solution of about 4%, by weight, of ammonium citrate in water. The results are depicted in the table below.

TABLE 1

Total Dissolved Iron

| Solutions | Chemicals | Percent, By Weight |
|---|---|---|
| A | Citric Acid and Hydrogen Peroxide | ~6-10 |
| B | Hydrochloric Acid | ~25 |
| C | Hydrogen Peroxide | ~3 |
| D | Nitric Acid and Hydrogen Peroxide | ~70 |
| E | Ammonium Citrate and Hydrogen Peroxide | ~15 |

The amount of iron removed from a scale deposit is depicted above in Table 1. A mineral acid such as HCl and $HNO_3$ is too aggressive toward the metallurgy of the underlying surface. As depicted above, citric acid or ammonium citrate with hydrogen peroxide is effective, with ammonium citrate and hydrogen peroxide being more effective.

EXAMPLE 2

A first composition is made by combining 4 ml of $H_2O$ with 2 ml of $H_2O_2$ and 0.15 gram ammonium citrate in a first open beaker, and a second composition is made by combining 4 ml of $H_2O$ with 2 ml of $H_2O_2$ and 0.15 gram citric acid in a second open beaker. Respective quantities of 0.2 gram of the scale deposit of Example 1 are placed into each beaker. The solution is heated to 60° C. for 30 minutes. The scale deposit and solution is centrifuged, and the supernatant is removed and replaced with a fresh solution. The supernatant wash solutions are analyzed by Inductively Coupled Plasma Emission Spectroscopy (ICP) for metals. After four leaches of 30 minutes almost three-fourths of the iron may be dissolved using the ammonium citrate, while only about one-fourth of the iron may be dissolved using citric acid. Results are depicted below.

TABLE 2

Percent, By Weight, of Selected Dissolved Metals

| | Ammonium Citrate | | | Citric Acid | | |
|---|---|---|---|---|---|---|
| Leach | Fe | Ni | Cr | Fe | Ni | Cr |
| #1 | 18.1 | 28 | 1.2 | 7.2 | 2.3 | 1.1 |
| #2 | 25.3 | ~100 | 1.2 | 5.6 | 4.6 | 2.2 |
| #3 | 18.1 | 98 | 1.2 | 4.8 | 0 | 0 |
| #4 | 13.3 | 0 | 0 | 5.6 | 0 | 0 |
| Total | 74.8 | ~100 | 3.6 | 23.2 | 6.9 | 3.3 |

EXAMPLE 3

A composition or solution (Solution F) is made by combining 50 ml of $H_2O$, 1.85 gram of ammonium citrate, and 5 ml of $H_2O_2$ at 60° C. and is agitated at a rate of 100 agitations per minute. Next, 2.5 gram of the scale deposit of Example 1 is placed into the solution. The initial pH is 5.2 and increases to a pH of 7.2 after 21 hours, and the solution can generate pressure as oxygen evolves. At specified intervals of 21 hours and 45 hours, a sample aliquot is removed and analyzed for iron by ICP and sulfate by ion chromatography (IC) by ASTM D 4327-03 method. After 45 hours, a fresh portion of Solution F is applied to the scale deposit, and a sample of aliquot is removed and analyzed after 24 more hours using the same testing procedures for the samples withdrawn at 21 and 45 hours above. The results are depicted below.

TABLE 3

Percent, By Weight, of Dissolved Scale Deposit Components

| Time | Fe | Ni | Cr | S |
|---|---|---|---|---|
| 1. After 21 hours | 36.5 | 32 | 5 | 18.1 |
| 2. After 45 hours | 39.7 | 34 | 5 | 21.8 |
| 3. New Solution after 24 hours | 22.1 | 15 | 4 | 7.8 |
| Total Dissolved (Sum of Lines 2 + 3) | 62 | 49 | 9 | 30 |

A significant amount of the components are dissolved from the scale deposit after 21 hours, but lesser amounts are dissolved after 45 hours as compared to the first 21 hours. However, 24 hours after application of a fresh solution more components are dissolved from the scale deposit as compared to the previous 24 hours (between 21 and 45 hours).

EXAMPLE 4

The Solution F of Example 3 is compared to another sample made with the same composition, except without hydrogen peroxide, and by the same procedure according to Example 3. Both compositions are applied to the same amount of the scale deposit of Example 1 in the same manner. The results are depicted below:

TABLE 4

Percent, By Weight, of the Dissolved Scale Deposit Iron and Sulfur

| | Fe | S |
|---|---|---|
| With Hydrogen Peroxide 21 hours | 36.5 | 18.1 |
| Without Hydrogen Peroxide 24 hours | 6.0 | 0.2 |

Ammonium citrate without hydrogen peroxide dissolves a small amount of the scale deposit as compared to a composition including ammonium citrate and hydrogen peroxide. As depicted, including hydrogen peroxide with the ammonium citrate can dissolve greater amounts of iron and sulfur from a scale deposit.

EXAMPLE 5

The pH of the Solution F is measured during the first 21 hours of dissolving the scale deposit, as discussed in Example 3.

TABLE 5 pH and Percent, By Weight, of the Dissolved Scale Deposit Components

| Time (Hr) | pH | Fe | Ni | Cr | S |
|---|---|---|---|---|---|
| 0 | 5.18 | — | — | — | — |
| 1.25 | 5.01 | 7.9 | 15 | 0.7 | 6.1 |
| 2 | 5.05 | 12.4 | 15 | 0.7 | 5.8 |
| 4 | 5.09 | 20.6 | 19 | 1.2 | 7.7 |
| 6 | 5.16 | 27.5 | 22 | 1.2 | 10.1 |
| 21 | 7.2 | 36.5 | 32 | 5 | 18.1 |

The percent of dissolved scale is shown above as a function of time. After 6 hours the pH may change very little, while the dissolution of the scale deposit continues.

A composition including ammonium citrate and hydrogen peroxide can clean surfaces of scale deposits in processing equipment and vessels, such as a hot combined heat exchanger. Under suitable conditions, a scale deposit may dissolve iron and sulfur components at a rate of about 3 to about 4%, by weight per hour based on the total iron and sulfur present in the scale deposit. Although not wanting to be bound by theory, it is believed that the hydrogen peroxide can enable the oxidation of sulfide to sulfate, as evidenced by the drop in pH at the beginning of the treatment and the detection of sulfate in a solution. Fresh ammonium citrate solution can further dissolve components from the scale deposits as compared to a used solution possibly due to the limited solubility of iron citrate.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing, all temperatures are set forth uncorrected in degrees Celsius and, all parts and percentages are by weight, unless otherwise indicated.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for removing one or more scale deposits formed on a surface, comprising the steps of:

providing a composition having a first pH of less than about 7.5 to prevent polythionic acid stress corrosion cracking to said surface, said composition comprising:

a) an effective amount of an organic acid and/or a salt thereof; and b) an effective amount of an oxidizing agent selected from the group consisting of a peroxide, a chlorate, a perchlorate, a nitrate, or a permanganate, wherein the organic acid and/or the salt thereof and the oxidizing agent in the composition are in a weight ratio of about 2.5:1 to about 1:10;

providing scale deposits comprising primarily metal sulfides and coke formed on said surface, wherein said scale deposits are formed in a hydrocarbon conversion process;

contacting the surface with said composition for a period of time sufficient to remove one or more scale deposits, wherein during said contacting step, the composition has a second pH, said second pH being greater than the first pH.

2. The process according to claim 1, wherein the composition comprises the organic salt, said organic salt comprising ammonium citrate.

3. The process according to claim 1, wherein the composition comprises the organic acid, said organic acid comprising citric acid.

4. The process according to claim 1, wherein the oxidizing agent comprises hydrogen peroxide.

5. The process according to claim 1, wherein the surface is a hydrocarbon processing apparatus.

6. The process according to claim 1, wherein the metal sulfide scale deposits comprises at least one of iron sulfide, nickel sulfide, iron-nickel sulfide, iron-chromium sulfide or chromium sulfide.

7. The process according to claim 1, wherein the organic acid and/or the salt thereof and the oxidizing agent in the composition are in a weight ratio of about 2.5:1 to about 1:5.

8. The process according to claim 1, wherein the organic acid and/or the salt thereof and the oxidizing agent in the composition are in a weight ratio of about 2.5:1 to about 1:2.5.

9. The process according to claim 1, wherein the surface is contacted with the composition for at least about 30 minutes.

10. The process according to claim 1, wherein the surface is contacted with the composition at a temperature of about 30° to about 80° C.

11. The process according to claim 1, further comprising removing the composition from the surface and recontacting the surface with a fresh batch of the composition.

12. The process according to claim 5, wherein the hydrocarbon processing apparatus comprises a heat exchanger.

13. The process according to claim 12, wherein the heat exchanger comprises a tube and shell wherein the surface comprises an exterior of one or more tubes in the heat exchanger.

14. The process according to claim 13, wherein one or more tubes of the heat exchanger comprises stainless steel.

* * * * *